US009498779B2

(12) United States Patent
Brendler et al.

(10) Patent No.: US 9,498,779 B2
(45) Date of Patent: Nov. 22, 2016

(54) METHOD FOR REGULATING THE ROLL GAP PRESSURE OF A ROLLER PRESS

(75) Inventors: Dieter Brendler, Bergisch Gladbach (DE); Meinhard Frangenberg, Kuerten (DE); Hans-Peter Makulik, Cologne (DE); Stefan Seemann, Bergisch Gladbach (DE)

(73) Assignee: KHD Humboldt Wedag GmbH, Cologne (DE)

( * ) Notice: Subject to any disclaimer, the term of this patent is extended or adjusted under 35 U.S.C. 154(b) by 488 days.

(21) Appl. No.: 14/113,331

(22) PCT Filed: Mar. 23, 2012

(86) PCT No.: PCT/EP2012/055191

§ 371 (c)(1),
(2), (4) Date: Oct. 22, 2013

(87) PCT Pub. No.: WO2012/146446

PCT Pub. Date: Nov. 1, 2012

(65) Prior Publication Data

US 2014/0048634 A1 Feb. 20, 2014

(30) Foreign Application Priority Data

Apr. 26, 2011 (DE) ..... 10 2011 018 705

(51) Int. Cl.
*B02C 4/32* (2006.01)
*B30B 3/04* (2006.01)

(52) U.S. Cl.
CPC .. *B02C 4/32* (2013.01); *B30B 3/04* (2013.01)

(58) Field of Classification Search
CPC ..... B02C 4/32; B30B 3/04
USPC ..... 241/37
See application file for complete search history.

(56) References Cited

U.S. PATENT DOCUMENTS 4,368,165 A * 1/1983 Bergendahl ..... B30B 11/006 100/173

FOREIGN PATENT DOCUMENTS

| | | | |
|---|---|---|---|
| DE | 4226182 A1 * | 2/1994 | ..... B02C 4/32 |
| DE | 4414366 | 10/1995 | |
| EP | 0320853 | 6/1989 | |
| FR | 2692171 | 12/1993 | |

OTHER PUBLICATIONS

International Search Report, Jun. 28, 2012.

* cited by examiner

*Primary Examiner* — Mark Rosenbaum
(74) *Attorney, Agent, or Firm* — Greer, Burns & Crain Ltd.

(57) ABSTRACT

A method for regulating the roll gap pressure of a roller press and a corresponding roller press. The roll gap pressure is regulated dependent on at least one oscillating movement that is measured on the roller press. This has the advantage that the roller press can always be operated at the maximum roller press efficiency without the roller press reaching the overload range.

11 Claims, 2 Drawing Sheets

METHOD FOR REGULATING THE ROLL GAP PRESSURE OF A ROLLER PRESS

CROSS-REFERENCES TO RELATED APPLICATIONS

This application claims the benefit of the German patent application No. 10 2011 018 705.7 filed on Apr. 26, 2011, the entire disclosures of which are incorporated herein by way of reference.

BACKGROUND OF THE INVENTION

The invention relates to a method for regulating the roll gap pressure of a roller press and to a roller press corresponding thereto.

Roller presses which consist of two—as a rule—identically sized, rotatably mounted rollers which run in opposite directions, rotate at the same circumferential speed and form a narrow roller gap between them, are frequently used for crushing or compacting granular material. The material to the crushed or compacted is pulled through said roll gap, the granular material being crushed or compressed under the high pressure prevailing in the roll gap. The result of said treatment, namely crushing or compacting, is for the main part dependent on the material characteristics of the granular material to be crushed. The crushing process in the roll gap described here was described for the first time as high-pressure crushing by Schonert et al. in German Disclosure DE 27 08 053 A1 and since then it has been applied as a genus of the types of crushing along with grinding by means of cutting and breaking.

Along with the pressure in the roll gap, high-pressure crushing calls for a plurality of parameters to be maintained in the roller press used for an optimum, low-energy and low-wear crushing process. For example, it is important for the rollers of the roller press used to rotate without relative slippage so that the rollers, as a result of the grinding material moving in a shearing manner, do not grind but press exclusively. In addition, it has been shown that the correct amount of fresh material supplied per unit time to the roll gap of the roller press used also plays a considerable roll for the optimum operation of the roller pressure used. If the roll gap is provided with too small an amount of fresh material per unit time, the roller press operates as a breaker, in particular when using rollers equipped with hard reinforcing bodies, the granular material to be crushed as fresh material being broken by point loads. Said type of crushing is less energy-efficient than high-pressure crushing and it does not result in the desired fine product. If, contrary to this, the roll gap is provided with too large an amount of granular material as fresh material per unit time, the grinding material, produced by fresh material and circulating material, is compressed too strongly in the roll gap such that enclosed air is not able to escape and the roll gap of the roller press used tends to get really blocked up. The resiliently mounted rollers deflect in this case, the fresh material, present in excess, falls uncrushed through the roll gap and the roller press then operates in the previous state again until it has to deflect repeatedly in order to allow the fresh material, present in excess, to pass through the roll gap. The roller press thus moves into a first type of oscillatory motion alongside other oscillatory motions and it begins to vibrate mechanically.

Along with said type of mechanical oscillation, which is generated as a result of the rollers creeping forward and backward in their resilient bearing arrangement at a frequency which is high compared to the moved masses, there is a further oscillatory motion inside the roller press in the form of an oscillatory motion of the rollers which is generated on the rotating rollers by the repeated, braking action of the over-filled roll gap. As a result of said rhythmical braking which is brought about by an over-filled roll gap and renewed acceleration by the drive, the rollers move into a rotational oscillation where the moment and the angular speed of the roller fluctuate in a steady manner. In particular, this is the case with driven rollers when a roller press has only one driven roller with a co-rotating roller.

Particular types of oscillatory motions can be generated when the overload with too much fresh material occurs only in one part of the roll gap. The rollers can then exhibit a combined oscillation which consists of a forward and backward movement of the rollers in the horizontal direction at right angles to the extension of the roll gap and of a rotational oscillation. In this case, the rollers can also run through a slight, oscillating change in position where the respective roller carries out a rotation about a vertical axis by very small angular amounts. In the case of said movement, the roller is not displaced evenly with both bearing blocks that support it, but rather the two bearing blocks change their position alternately with respect to one end each of a roller.

Mechanical oscillatory motions of very short duration and high frequency and amplitude in the form of an impact are also generated during the passage of pieces of fresh material which are too large or during the passage of constituent parts which are not crushable by high-pressure treatment in the roll gap, such as, for example, metal pieces, that is hammer heads, large steel rivets or bolts, digging teeth or other unwanted metal parts, which are situated in an unwanted manner in the fresh material and are able to pass in an undesirable manner into the fresh material when the raw material is dismantled.

In addition, mechanical oscillatory motions can also be generated inside a roller press during the operation to start-up the roller press when the grinding material is not yet circulating in a balanced manner or the circulating material has a composition which is not yet balanced. Finally, mechanical oscillatory motions are also generated when fresh material which is wet and fine-grained is used.

If the frequency of an aforementioned mechanical oscillatory motion accidentally reaches the frequency of a natural oscillation of the roller press, with every individual oscillatory motion more energy is transmitted to the entire system of the roller press, as a result of which serious damage can be caused to the bearings, the roller surfaces and other components of the roller press as a whole, not least of all consequently because the rollers can reach an individual weight of in excess of 70 t and an oscillating mass of said order of magnitude presents very great challenges to even very sturdy machine frames.

Naturally, the entire system of the roller press is damped mechanically as a result of its design. The damping is provided on the one hand by the hydraulic system in which the hydraulic fluid flows back and forth at high speed through the lines, which are fine compared to the diameters of the hydraulic plunger or cylinder, and damps very strongly as a result. In addition, the movement of the bearing blocks along the slide rails of the loose rollers also absorbs a high mechanical energy in the form of friction, as a result of which an oscillatory motion is damped.

However, insofar as the roller press moves into an unwanted oscillatory mode it is shown that the roller press no longer operates in an energy-efficient manner and over and above this is also strongly loaded mechanically.

In order to avoid or to prevent mechanical oscillatory motions being realized at all in the roller press, generated by over-loading the roll gap with fresh material, the amount of fresh material discharged per unit time can be regulated by, for example, less fresh material per unit time being put onto the roll gap by the discharge apparatus when an unwanted oscillatory motion is detected in the roller press. However, the disadvantage of this is that a comparatively long reset time for the regulated section from the controlled feed apparatus up to the detected oscillatory motion has to be accepted. A certain time passes until the modified feeding of the roll gap operates with fresh material and finally the oscillatory motion is reduced as a result. Up to that point, considerable damage can have been caused to the roller press or can accumulate when this type of regulating intervention is necessary more frequently.

The following measures from the prior art are known for monitoring the functioning of crushing apparatuses:

Printed document US2010/0102152A1 describes conical breakers which are provided with approximation sensors such as, for example, ultrasound sensors or laser sensors. By measuring the width of the outlet gap, the width of the gap can be adapted to the process conditions by means of lifting or lowering the cone, as a result of which uneven rotations which can damage the cone are avoided.

US2004/0255679A1 describes a rotary drum grinder for crushing minerals, said rotary drum grinder having an acoustic sensor in the drum by way of which it is possible to detect loads on the drum that are too heavy, e.g. caused by solid rock.

DE10132067A1 discloses a method for acoustically monitoring threatening operating states, e.g. slippage, in cylinder mills. To this end, the noises occurring in the cylinder mill, e.g. the noise level, are detected by way of a microphone and the frequency spectrum is evaluated.

However, none of the printed documents disclose how said unwanted operating states can be avoided or eliminated.

It would consequently be desirable if a roller press were to be able to be operated in such a controlled manner that the mechanical oscillatory motions do not take place. Consequently, it is the object of the invention to operate a generic roller press such that a mechanical oscillatory motion does not occur.

SUMMARY OF THE INVENTION

The object of the invention is achieved by a method for regulating the roller press with the features of claim 1. Further advantageous developments of the invention are provided in the sub-claims.

It is provided as claimed in the invention to regulate the roll gap pressure in dependence on oscillatory motions which are detected inside the roller press.

In a preferred embodiment of the method, the regulated section in the roller press includes as a regulating input variable a signal which indicates the detection of oscillatory motions, it being possible for a simple development of the detection of the oscillatory motion to be the plain detection of oscillatory motions of a certain frequency, a frequency range or an oscillatory motion below a certain frequency with a minimum amplitude, and in a preferred embodiment of the method also the detection of selected oscillatory modes of the roller press. An oscillatory mode is a movement pattern of the oscillatory motion inside the entire roller press which is independent of another oscillatory pattern of the same roller press at the same time; in the simplest case this is an oscillatory motion in the longitudinal direction and an oscillatory motion in the transverse direction of the roller press. As the roller press can have a plurality of oscillatory patterns, the number and type of which is very strongly dependent on the design and the geometry of the roller press, it can—depending on the design of the roller press—be advantageous to be increasingly attentive to a characteristic oscillatory pattern when regulating. In order to detect the individual oscillatory modes, it is provided for not just one detector to detect oscillatory motions but for more than one detector to be present at selected locations of the roller press and to detect typical oscillatory motions in the form of a pattern. First of all, the pattern of a typical oscillatory motion is forwarded by the regulating apparatus as a regulating input variable in the regulating loop. If the intensity of the detected oscillatory motion exceeds a minimum amount, this then just leads to a reduction in the pressure in the roll gap. The regulating process in the roller press can be developed as on/off regulating, but also as continuous regulating which reduces the roll gap pressure in proportion to or at least continuously with the increasing oscillation intensity.

The measuring variable in the regulated section is therefore either the frequency of a measured oscillatory motion, the amplitude of a measured oscillatory motion or also the two measuring variables together, the expected frequency being filtered out of the measured signal, for example, by means of a frequency switch and the amount of filtered-out data entering the regulated section in the form of an intensity variable. The oscillatory motion is therefore measured by means of the signal of a frequency switch.

The oscillatory motions, in this case, can either be directly measured or they can also be indirectly measured. Direct measuring can, for example, be measured by tracking the signal of a strain gauge at selected locations of the roller press. Where the very heavy rollers move forward and backward in a rhythmical manner, the supports of the machine frame can be entrained in a synchronous or push-pull manner within the range of their elasticity in their length. The changes in the length of a support in the machine frame—albeit very small—, even when the changes in the length are in the μm-range, are still however comparatively easily detected by the strain gauges. These have to be protected, however, in the very rough operation of the roller press in typical use from external, harmful influences by means of a corresponding encapsulation. Very small semi-mechanical or semi-conductive acceleration sensors or pendulum sensors, inside which a damped pendulum, which has a corresponding restoring force as a result of a mechanical resilience, co-oscillates and said oscillations are absorbed inductively or in another manner, are suitable in order to be able to detect not changes in length but oscillatory motions at right angles to the extension of a frame element. When detecting the oscillatory motion, in particular when detecting patterns of individual oscillatory motions, care must be taken to ensure that an acceleration sensor generates a signal which is ahead of the signal of a strain gauge by approximately Pi/2, or of a one-fourth oscillatory motion. The expert is very familiar with detecting oscillatory motions, however care must be taken to ensure that the type of oscillatory detection or the type of detector used suits the very rough operating environment of a roller press. The smaller the sensor, the more sensitive it is, as a rule, also with regard to mechanical influences.

Instead of mechanical oscillatory detection or semi-mechanical oscillatory detection by means of strain gauges, inside which the electric resistance of a metal, semi-conducting or piezo-electric strip changes as the strip expands or an electric voltage builds up as the strip expands, it is also possible to measure an indirect variable as an auxiliary variable in order to avoid sensitive sensors having to be arranged on the machine frame. In this way, for example, the measuring of the time behavior of the pressure in the hydraulic system which generates the roll gap pressure is suitable. The pressure sensors can be accommodated at a protected position and the variation in the pressure in the hydraulic system which generates the roll gap pressure is suitable in an excellent manner for detecting the forward and back movement of the rollers inside the freedom of movement of the rollers along the slide rails of a loose roller. Yet another possibility for detecting oscillations is the measuring of the current consumption of the drive of a roller. The oscillations measured in this connection accompany a rotational overall oscillation of the rollers or also for measuring the torsional oscillation of a roller, or of the shaft in the drive. The torsional oscillation and the rotational oscillation are differentiable by their frequency, their restoring time and possibly also by the type of the typical harmonics in the measured signal over time. In the case of rotational oscillation the entire drive train up to the roller is synchronous, whereas in the case of torsional oscillation part of the overall rotating part of the roller press is in pull-push mode with respect to another part of the same rotating part of the roller press.

The simple oscillation measurement is suitable for averting damage to the roller press and is it also possible to operate the roller press at such a high pressure that the unwanted oscillatory motions do not occur at all. As a result, the roller press can always be operated at the maximum of its productive capacity without the roller press operating less efficiently due to overload and where possible even taking on damage. The measuring of oscillatory motions with selection of typical oscillation patterns or the frequency analysis by means of harmonic wave analysis of the measured oscillatory motions also makes it possible to operate the roller press close to the critical range of the roller gap pressure with reference to oscillation formation. As there is a plurality of causes for the occurrence of oscillatory motions and or of impacts or where applicable also rhythmically changing load conditions, the selection of oscillatory patterns by means of microprocessor-operated regulation makes possible the advantage of filtering out negligible oscillatory motions or causes of oscillatory motions which are non-harmful, such that it is not necessary to operate the roller press frequently in the short-term or even in the longer-term at lower roll gap pressure as a result of error detection, as a result of which the mean crushing performance of the roller press over time drops and in the extreme case the circuit in a circular crushing installation can run constantly outside the stationary balanced state as a result of unwanted oscillation detection, which results in a high number of unnecessary regulating interventions in the roller press, which can finally lead to premature wear or failure of the roller press.

The oscillatory motions of individual elements of the roller press occurring in a roller press exhibit different types of oscillations. First of all, the bending oscillation of an almost arbitrary elongated element, for example that of a support or an elongated connection is possible in any form. Said oscillation can be measured the best with an acceleration sensor, fully mechanical or semi-mechanical in the form of an integrated semiconductor with an acceleration measuring function. All elements which extend over a larger section in the roller press can have oscillations in their length within the range of their elasticity, the oscillation amplitudes also being very small. Said longitudinal oscillations can be measured by placing the movement sensor on the end of the elongated element, and also by attaching a strain gauge in the center of the element which changes in length.

Rotating elements, such as, for example, the drive train from the motor to the roller can exhibit rotational oscillations, the entire drive train varying its rotational speed rhythmically in a synchronous manner, but also torsional oscillations in which different parts of the drive train oscillate in opposite directions or in a phase-shifted manner, the rotating element being twisted rhythmically within the boundaries of the elasticity.

As an option, a simple regulating apparatus can measure only one of said oscillatory motions as a signal of an oscillatory motion, but can also measure more than one and couple the signals together or filter out typical patterns from the detected oscillation patterns in order to ignore non-avoidable oscillatory motions in the circular grinding system. Causes for the detection of negligible oscillation patterns can be: a bucket conveyor which pours fresh material rhythmically onto the roller press, a conveyor belt which conveys rhythmically or is itself moved to oscillate, oscillations in the hydraulic system which are generated by a possibly knocking pump, or oscillations in the current consumption which possibly occur in the power supply as a result of oscillatory motions of an adjacent roller press and consequently form an unwanted electric oscillating circuit with the drive train, are able to be filtered out in this way. A particular embodiment of the regulating apparatus carries out a frequency analysis, the frequency spectrum of the measured oscillatory motions being broken down into individual spectral components by the computer. The measured spectrum is broken down into a composition of oscillation components by means of a real-time regression analysis, the composition being a vector from different linear factors of the overall oscillation. A linear factor for an unwanted oscillatory motion is then derived from said vector and by way of said linear factor or as a result of the linking between different linear factors, the regulated input variable for the regulating apparatus is generated. Depending on the strength of the signal generated in this way, the damping of the roll gap pressure is more or less, the damping of the roll gap pressure being greater with stronger oscillatory motion or, in other words, the more intensive the detected oscillation, whatever the type, the less the roll gap pressure is adjusted and vice versa.

When measuring the torsional oscillation of the drive shaft by means of a strain gauge, the problem is how the signal can be directed from a moved shaft to a stationary regulating apparatus. As the shafts do not rotate at a high speed, the strain gauge can be connected to an electronics unit which is fixedly arranged on the roller and transmits its data by means of a radio apparatus or by means of an RFID chip to a stationary regulating apparatus. As the electronics unit on the roller requires electric current, this can be made available by an accumulator which is continuously recharged by a coil/magnet combination. For this purpose the coil is situated in a stationary manner on the shaft and the magnet is situated in a stationary manner on the machine frame and the two elements are positioned such that the coil situated on the shaft is guided past the magnet at every revolution by the shaft and an electric current, which recharges the accumulator or capacitor depending on the current requirement of the measuring electronics, is thus generated inductively in the coil situated on the shaft.

Depending on the requirement, a simple electronic unit which reduces the roll gap pressure in dependence on the intensity of a measured oscillatory motion, is suitable as a regulating loop, or a more complicated, microprocessor-controlled regulating apparatus which has the advantage of being able to derive information on the state of the roller press from the oscillation states of the roller press as a secondary product.

A frequency which lies clearly below the rotational frequency of the rotating rollers, indicates, for example, non-correct functioning of the regulating of the fresh material. A frequency which is a single or a complete multiple of the rotational frequency of the rollers can point to an overload of the roll gap which can be undertaken by a short-term reduction of the hydraulic pressure which occurs comparatively rapidly. A frequency which is not a whole multiple of the rotational frequency of a number of revolutions found in the drive train and is less than or lies within the range of the number of revolutions of the rollers, indicates foreign oscillatory motions, for example an unwanted rhythmically conveying conveyor belt or a bucket conveyor which unloads its freight in a jerky manner. Detected oscillations of short duration and high frequency suggest the passage of a non-crushable material which, where applicable, is able to pass through the roller press multiple times in the circuit and thus can destroy it. This can be used as a warning to stop a roller press or at least stop a circuit of the circular grinding system. Finally, a frequency which is clearly higher than the circulating frequency of the rollers but is synchronized with the circulating frequency of the rollers indicates bearing damage. Finally even higher frequencies can indicate faults in a converter in the electric power supply. A lot of information which is readable in the control room and provides the operating personnel with useful and valuable pointers to the operating state of the roller press can be provided by the frequency analysis.

BRIEF DESCRIPTION OF THE DRAWINGS

The process-engineering invention is described below by way of the flow diagram and an exemplary embodiment, in which, in detail.

DETAILED DESCRIPTION OF THE PREFERRED EMBODIMENTS

Figure 1:
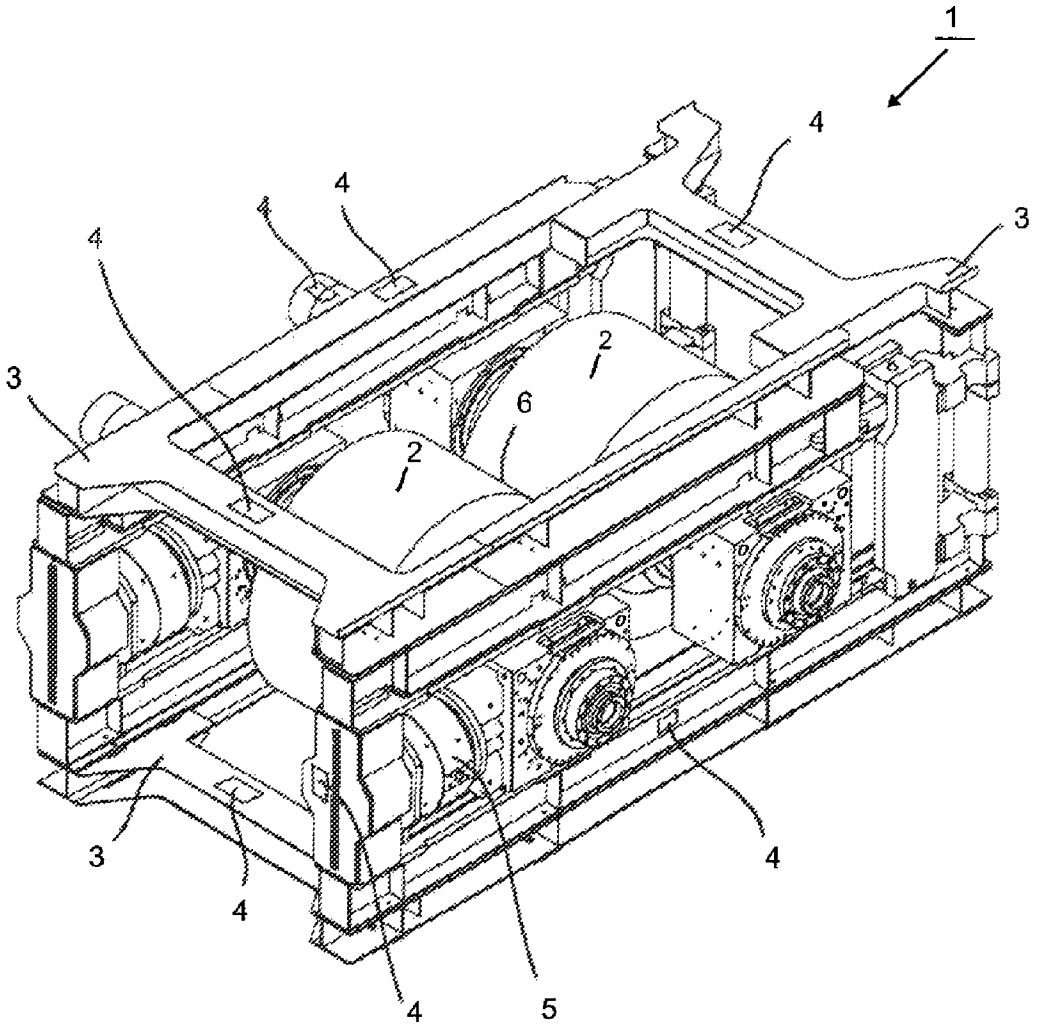
FIG. 1 shows a representation of the inventive roller press as claimed with several strain gauges as sensors for detecting oscillatory motions

FIG. 1 shows a generic roller press 1 which has two rollers 2 which rotate in opposite directions and are accommodated in a machine frame 3 which, in turn, is provided at different positions with sensors 4 for detecting oscillatory motions. The two rollers 2 of the roller press 1 are pressed toward one another by means of hydraulic plungers 5, only one of which is provided here with a reference, without however contacting one another at the same time. By means of a feeder apparatus (not shown here) the fresh material to be crushed is discharged onto the roll gap 6 of the roller press 1 and at the same time is crushed by the pressure prevailing between the two rotating rollers 2. Strain gauges 4 are mounted at different positions of the machine frame 3 of the roller press 1 as sensors for detecting oscillatory motions. The oscillations measured by the strain gauges 4 are forwarded to an evaluating apparatus (not shown here) where the amplitude and/or the frequency of the measured oscillatory motion is/are compared to a previously determined required variable. If the amplitude at a predetermined frequency exceeds a critical value, the pressure in the pressure cylinder 5 is reduced in a corresponding manner, as a result of which the pressure in the roll gap 6 also drops. If the intensity of the oscillatory motion reaches below the previously determined critical range again as a result of the reduction in the roll gap pressure, the pressure is slowly increased again by means of a regulating strategy, in a preferred manner according to the PID (Proportional Integral Derivative) method such that the roller press 1 always operates within a pressure range which directly adjoins the critical range.

Figure 2:
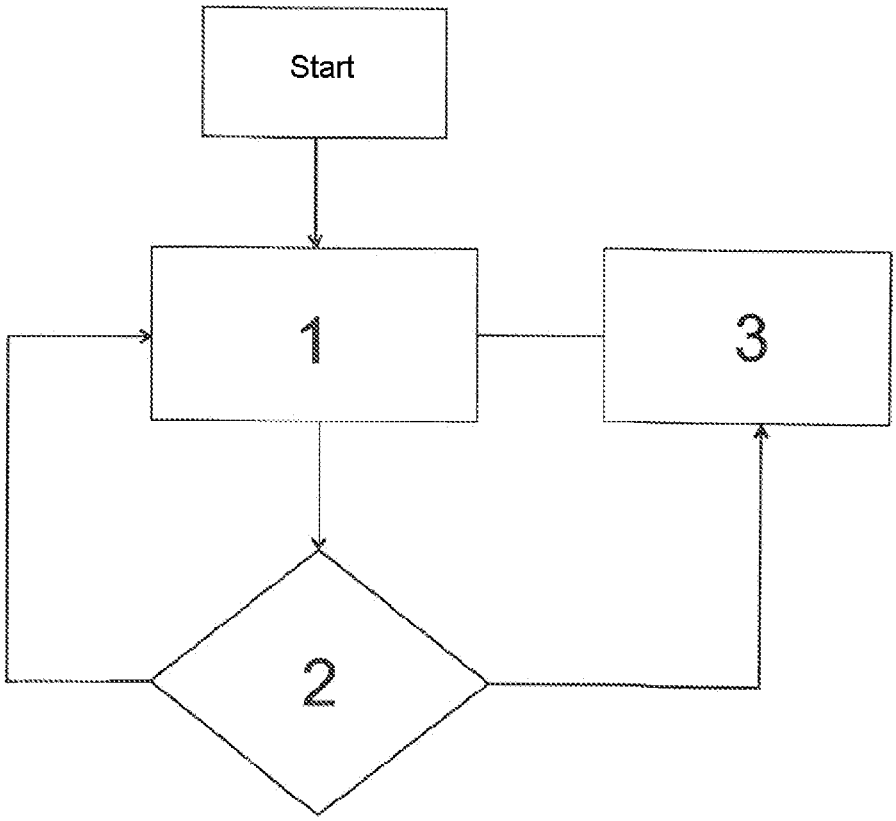
FIG. 2 shows a flow diagram of the regulating loop.

FIG. 2 shows a flow diagram of a regulating loop of the method as claimed in the invention. Starting with step 1, the time behavior of the signal of a strain gauge, of an acceleration sensor, of the pressure in the hydraulic system which generates the roll gap pressure or of the current consumption of the drive of the rollers in the roller press is measured. Said data is processed, for example frequency filtering is performed or the frequency spectrum is processed and reduced to a few linear factors of different spectral components and in step 3 is compared to a required value. Insofar as the required value is achieved, a decision is made in step 2 as to whether a regulating intervention is to take place and in the case of an affirmative answer the pressure in the roll gap is reduced in step 3. The first circuit is closed at this point. Arriving at the step 2 once again, if the answer to achieving the required value is negative, a different path is followed which leads to a continuous increase in the roll gap pressure until the critical value of the roll gap pressure is achieved and once again is reduced. In order to avoid a regulating oscillation generated by this, a known regulating strategy is followed, for example a PID regulating strategy, by means of which the controlled variable is slowly approximated to a value without the regulating loop oscillating.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF REFERENCES

1 Roller press
2 Roller
3 Machine frame
4 Vibration sensor
5 Pressure cylinder
6 Roll gap

The invention claimed is:

1. A method for regulating a roll gap pressure of a roller press having current consuming drive for a roller of the roller press, comprising:

detecting an oscillatory motion of a roller of the roller press by measuring a time behavior of a current consumption of the roller drive, and regulating the roll gap pressure in dependence on at least the oscillatory motion which is measured on the roller press via the current consumption of the roller drive.

2. The method as claimed in claim 1, wherein at least one of frequency and amplitude, is used as a measuring variable in a regulated section of the roller press.

3. The method as claimed in claim 1, wherein at least one oscillatory motion is additionally measured at least one of directly as a mechanical oscillatory motion and indirectly by means of an auxiliary variable.

4. The method as claimed in claim 3, wherein at least one of the at least one oscillatory motion is additionally measured one of by means of a signal of a strain gauge as a function of time and by means of a damped pendulum.

5. The method as claimed in claim 3, wherein at least one of the at least one oscillatory motion is additionally measured by means of a time behavior of the pressure in a hydraulic system which generates the roll gap pressure.

6. The method as claimed in claim 1, wherein the oscillatory motion is measured by means of the signal of a frequency switch.

7. The method as claimed in claim 3, wherein at least one of the following are measured as oscillatory motion:

a bending oscillation of a support of a machine frame, a linear oscillation of a support of a machine frame in the form of a change in length, a torsional oscillation of a shaft between a roller and a drive, and the rotational oscillation of the shaft between the roller and the drive.

8. The method as claimed in claim 2, wherein at least one oscillatory motion is additionally measured at least one of directly as a mechanical oscillatory motion and indirectly by means of an auxiliary variable, and wherein the regulating is performed in dependence on a linear factor of an oscillatory mode when measuring more than one oscillatory motion.

9. A roller press having two rollers which operate in opposite directions, said roller press having a regulating apparatus for regulating a roll gap pressure, wherein feedback of at least one oscillation measured on the roller press with respect to the roll gap pressure corresponding thereto is provided as a regulated section, and including sensors for measuring the active current consumption of the drive of the rollers of the roller press.

10. The roller press as claimed in claim 9, wherein the regulating apparatus measures at least two different oscillatory motions as regulated input variables.

11. An apparatus as claimed in claim 10, including at least one of the following being provided as sensors for one of direct and indirect measuring of the at least one vibration:

strain gauges on a support of a machine frame of the roller press, pendulum sensors at an arbitrary location on the roller press, strain gauges on the shaft between the drive and the roller of the roller press, and pressure absorption sensors in the hydraulic system which generates the roll gap pressure.

* * * * *